US006747419B2

(12) United States Patent
Claus et al.

(10) Patent No.: US 6,747,419 B2
(45) Date of Patent: Jun. 8, 2004

(54) METHOD AND APPARATUS FOR HEAT PIPE COOLING OF AN EXCIMER LAMP

(75) Inventors: Holger Claus, Lake Forest, CA (US); Zoran Falkenstein, Foothill Ranch, CA (US)

(73) Assignee: Ushio America, Inc., Cypress, CA (US)

( * ) Notice: Subject to any disclaimer, the term of this patent is extended or adjusted under 35 U.S.C. 154(b) by 0 days.

(21) Appl. No.: 10/189,167

(22) Filed: Jul. 3, 2002

(65) Prior Publication Data

US 2004/0004422 A1 Jan. 8, 2004

(51) Int. Cl.[7] ..... H05B 41/16; H01J 1/00
(52) U.S. Cl. ..... 315/248; 313/238
(58) Field of Search ..... 313/238, 15, 17, 313/36

(56) References Cited

U.S. PATENT DOCUMENTS 5,928,607 A * 7/1999 Frisk ..... 422/29
6,194,821 B1 * 2/2001 Nakamura ..... 313/238
6,201,355 B1 * 3/2001 Morgan et al. ..... 315/248
6,379,024 B1 * 4/2002 Kogure et al. ..... 362/263

* cited by examiner

*Primary Examiner*—Don Wong
*Assistant Examiner*—Minh Dieu A
(74) *Attorney, Agent, or Firm*—J. D. Harriman, II Esq.; Coudert Brothers LLP

(57) ABSTRACT

Embodiments of the present invention are directed to a method and apparatus for heat pipe cooling of an excimer lamp. In one embodiment, a heat pipe is used to dissipate heat from an excimer lamp. The heat pipe is in direct contact with at least one electrode of the excimer lamp. In one embodiment, heat is transferred through the heat pipe to a cooling point that is electrically isolated from the lamp. In one embodiment, dissipation of heat from the cooling point is done by conventional means. In one embodiment, the heat pipe is on the inside of the lamp. In another embodiment, a heat pipe is attached to the outside of an excimer lamp. In another embodiment, two heat pipes are used, one on the inside and one on the outside of an excimer lamp. In yet another embodiment, a heat pipe is used with a flat lamp.

12 Claims, 7 Drawing Sheets side-on view of typical co-axial DBD lamp side-on view of typical co-axial DBD lamp end-on view of typical co-axial DBD lamp Figure 4
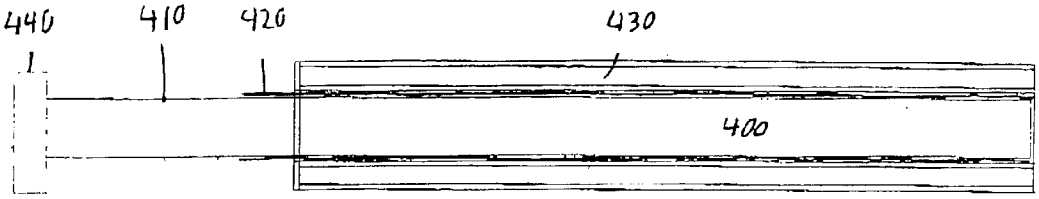
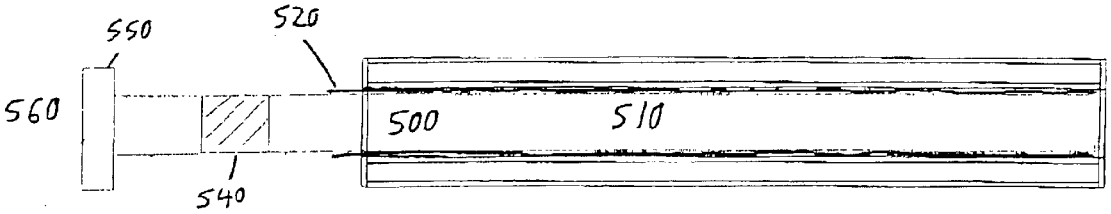
Figure 5

Figure 6
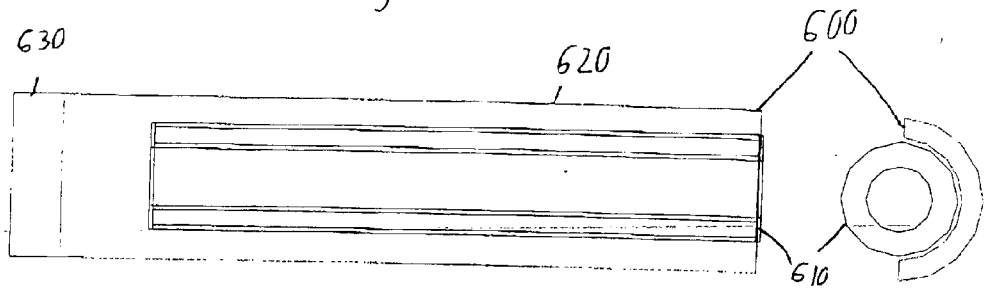
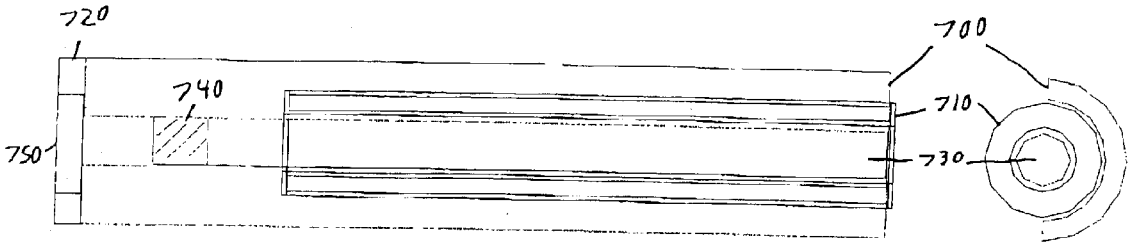
Figure 7

METHOD AND APPARATUS FOR HEAT PIPE COOLING OF AN EXCIMER LAMP

BACKGROUND OF THE INVENTION

1. Field of the Invention

The present invention relates to the field of excimer lamps, and in particular to a method and apparatus for heat pipe cooling of an excimer lamp.

2. Background Art

Between 60 and 90 percent of the energy input in an excimer lamp is dissipated as heat. The efficiency of excimer lamps is greater when the temperature of the lamp is lower. Thus, lamp temperatures in the range of 0 to 40 degrees C. are desirable from an efficiency standpoint. However, when an excimer lamp is not cooled, the temperature of the lamp rises to values of 50 to 130 degrees C., depending on the electrical power load and the convectional cooling conditions.

One way of cooling excimer lamps is to use water. The water is usually in direct contact with one electrode of the lamp. Since in most cases this electrode has a very high potential (on the order of 10000 V), serious electrical insulation problems arise. Thus, deionized water of the highest purity is used when the high-voltage electrode is cooled. Additionally, in many applications, cooling with water has significant disadvantages due to possible leaks and problems arising when the lamp is changed. Furthermore, the water must be contained in a closed system and cooled in an external unit. The cleanliness of the water has to be monitored and insured on a continuous base. These problems can be better understood with a review of excimer lamps.

Excimer Lamps

In excimer lamps, excited diatomic molecules (excimers) emit light in the deep ultra-violet ((V)UV), the ultra-violet (UV) or the visible spectral range when the excimers decay. One form of excimer lamp is driven by a dielectric barrier discharge (DBD). In a DBD driven excimer lamp, a high voltage is applied across a gas gap which is separated from metallic electrodes by at least one dielectric barrier. Dielectric barriers include, for instance, ceramic, glass, and quartz. FIG. 1A provides an example of a typical DBD driven excimer lamp.

DBD Driven Excimer Lamps

FIG. 1A is a side view of a coaxial DBD driven excimer lamp. The lamp envelope 100 is a transparent vessel that is typically comprised of glass or quartz. In common arrangements, an inner electrode 110 is separated by a dielectric barrier 120 from the excimer gas 130 enclosed within the envelope 100 and bounded on the outside by a second electrode 140 on the outer surface of the dielectric barrier.

FIG. 1B provides an end-on view of the same coaxial DBD lamp shown in FIG. 1A. In FIG. 1B, it can be seen more clearly that the inner electrode 110 and the outer electrode 140 are circular in shape, and that the excimer gas 130 is sealed between the two electrodes. The second electrode 140 may be a mesh which allows radiation from the plasma to be emitted through the lamp envelope. The discharge from a DBD driven excimer lamp is also widely known as "ozonizer discharge" as the utilization of DBDs in air (or oxygen) is a mature technology to produce large amounts of ozone. DBD driven excimer lamps are used to efficiently produce excimers when using rare gases, or mixtures of rare-gases and halogens as the discharge gas. The excimers emit radiation in the deep ultra-violet ((V) UV), the ultra-violet (UV), or the visible spectral range when they decay. This radiation can be used for various photo-initiated or photo-sensitized applications for solids, liquids and gases.

Typical efficiencies of DBD-driven excimer (V)UV light sources depend on the electron densities and electron energy distribution function and can be "controlled" mainly by the applied voltage frequency and shape, gas pressure, gas composition and gas gap distance. With typical arrangements, such a DBD configuration only operates in a range of 1–20% efficiency. Using steep-rising voltage pulses, efficiencies in the range of 20–40% can be obtained. Still, what makes these light sources unique is that almost all of the radiation is emitted spectrally selectively. For photo-initiated or photo-sensitized processes, the emission can be considered quasi-monochromatic. Since many photo-physical and photo-chemical processes (e.g., UV curing and bonding, lacquer hardening, polymerization, material deposition, and UV oxidation) are initiated by a specific wavelength (ideally the excimer light source will emit close to those wavelengths), these light sources can be by far more effective than high-powered light sources that usually emit into a wide spectral range.

Cooling Excimer Lamps

Excimer lamps perform more efficiently when cooled, and air cooling is typically insufficient. Thus, water is frequently used to cool excimer lamps. However, the water is usually in direct contact with one electrode of the lamp. For example, water used to cool the excimer lamp of FIGS. 1A and 1B would be in direct contact with the inner electrode 110, the second electrode 140 or both. Since in most cases this electrode has a very high potential (on the order of 10000 V), serious electrical insulation problems arise. Without sufficient insulation the danger of electrocution exists. One method of addressing this electrical insulation problem is to use deionized water of the highest purity. Pure, deionized water is significantly less conductive than non-deionized water and acts as an insulator rather than a conductor.

Another problem of cooling with water in many applications is due to possible leaks and problems arising when the lamp is changed. Furthermore, the water must be contained in a closed system and cooled in an external unit. The cleanliness of the water has to be monitored and insured on a continuous base to ensure the purity of the deionized water. Thus, water cooling is too expensive and complex of a method of increasing an excimer lamp's efficiency for use in certain applications.

SUMMARY OF THE INVENTION

Embodiments of the present invention are directed to a method and apparatus for heat pipe cooling of an excimer lamp. In one embodiment of the present invention, a heat pipe is used to dissipate heat from an excimer lamp. Heat pipes transfer heat at a rate that is up to 1000 times higher than copper. The heat pipe is in direct contact with at least one electrode of the excimer lamp. In one embodiment, heat is transferred through the heat pipe to a cooling point that is electrically isolated from the lamp. The cooling point has essentially the same temperature as the lamp. In one embodiment, dissipation of heat from the cooling point is done by conventional means (e.g., the use of fins, the use of forced air cooling or the use of liquids).

In one embodiment, the heat pipe is on the inside of the lamp. The heat pipe consists of 3 major parts: a section where the heat is transferred from the glass of the lamp to the heat pipe, a section that has an electrical insulation strength higher than the lamp voltage and a cooling part where the heat is transferred to the environment. In another embodiment, a heat pipe is attached to the outside of an excimer lamp. The heat pipe covers only part of the lamp. In one embodiment, since the outside electrode is grounded, no electrical insulation is necessary.

In another embodiment, two heat pipes are used, one on the inside and one on the outside of an excimer lamp. This allows efficient cooling of the lamp and operation at extremely high power levels. In yet another embodiment, a heat pipe is used with a flat lamp. One electrode is covered by a flat heat pipe. In still another embodiment, a flat heat pipe is used with a flat lamp and the heat pipe has an insulation section that electrically isolates the lamp electrode from the environment.

BRIEF DESCRIPTION OF THE DRAWINGS

These and other features, aspects and advantages of the present invention will become better understood with regard to the following description, appended claims and accompanying drawings where:

FIG. 4 is a block diagram of a heat pipe on the inside of the lamp in accordance with one embodiment of the present invention.

FIG. 5 is a block diagram of a heat pipe on the inside of the lamp where the cooling point is electrically insulated from the inner electrode in accordance with one embodiment of the present invention.

FIG. 6 is a block diagram of a side and end-on view of a heat pipe attached to the outside electrode of an excimer lamp in accordance with one embodiment of the present invention.

FIG. 7 is a block diagram of a side and end-on view of the use of two heat pipes to cool an excimer lamp in accordance with one embodiment of the present invention.

DETAILED DESCRIPTION OF THE INVENTION

The invention is a method and apparatus for heat pipe cooling of an excimer lamp. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Heat Pipe Cooling of Excimer Lamps

In one embodiment of the present invention, a heat pipe is used to dissipate heat from an excimer lamp. Heat pipes transfer heat at a rate that is up to 1000 times higher than copper. A heat pipe consists of a vacuum tight envelope, a wick structure and a working fluid. The heat pipe is evacuated and then back-filled with a small quantity of working fluid, just enough to saturate the wick. The atmosphere inside the heat pipe is set by an equilibrium of liquid and vapor.

Figure 1A:
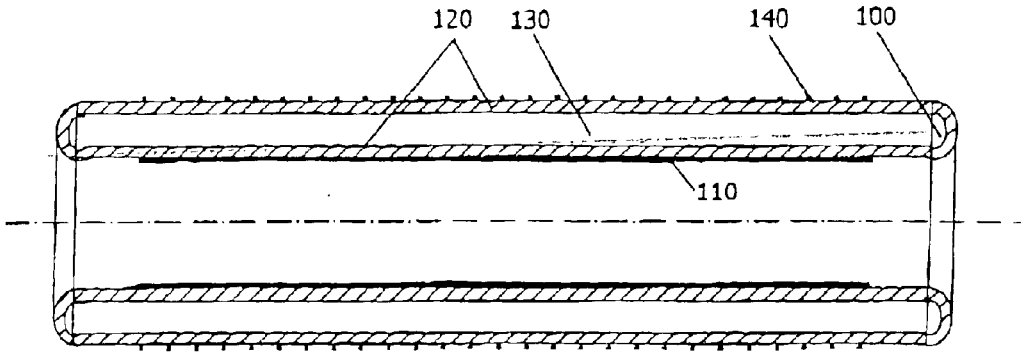
FIG. 1A is a side view of a prior art coaxial DBD lamp.
Figure 1B:
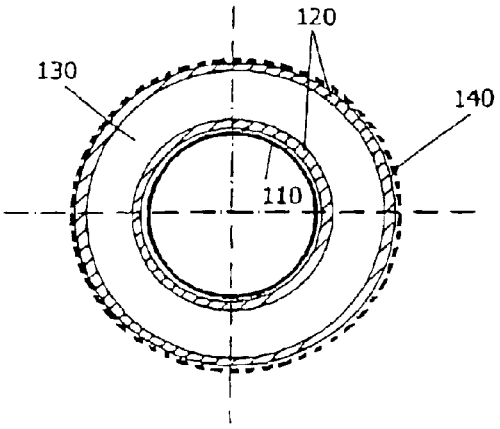
FIG. 1B is an end view of the same prior art coaxial DBD lamp.
Figure 2:
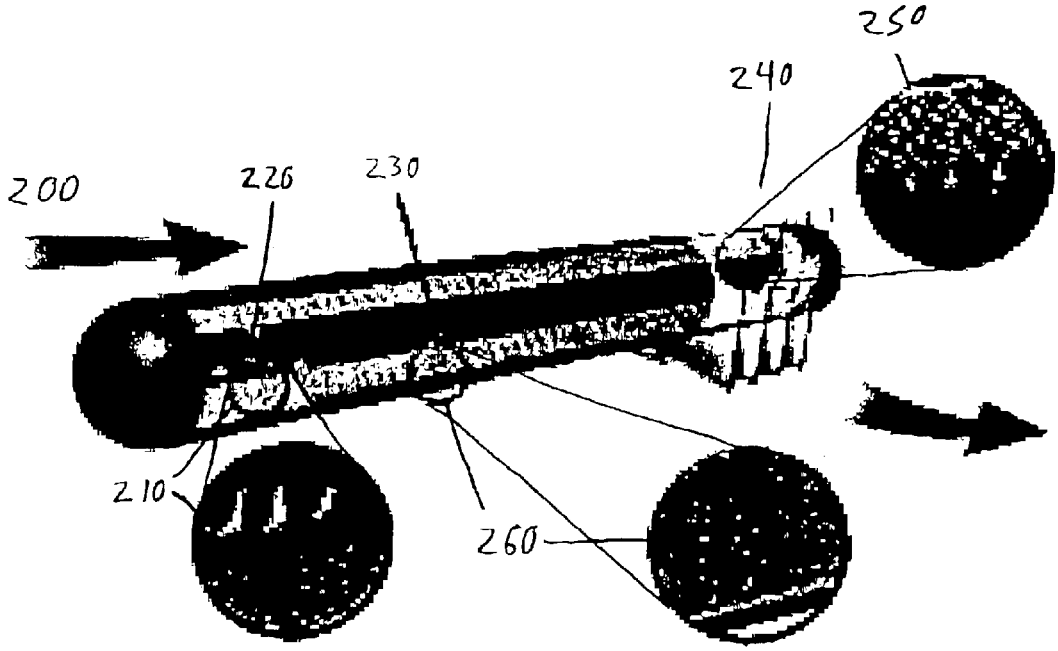
FIG. 2 is a block diagram of a heat pipe in accordance with one embodiment of the present invention.

FIG. 2 illustrates a heat pipe in accordance with one embodiment of the present invention. As heat 200 enters at the evaporator 210, the liquid/vapor equilibrium is upset, generating vapor at a slightly higher pressure 220. This higher pressure vapor travels 230 to the condenser end 240 where the slightly lower temperatures cause the vapor to condense 250, giving up its latent heat of vaporization. The condensed fluid is then pumped back to the evaporator by the capillary forces developed in the wick structure 260. This continuous cycle transfers large quantities of heat with very low thermal gradients. A heat pipe's operation is passive, being driven only by the heat that is transferred. This passive operation results in high reliability and long life.

In one embodiment, the evaporator end of the heat pipe is in direct contact with at least one electrode of the excimer lamp. Heat is transferred through the heat pipe to a cooling point that is electrically isolated from the lamp. The cooling point has essentially the same temperature as the lamp. In one embodiment, dissipation of heat from the cooling point is done by conventional means (e.g., the use of fins, the use of forced air cooling or the use of liquids).

Figure 3:
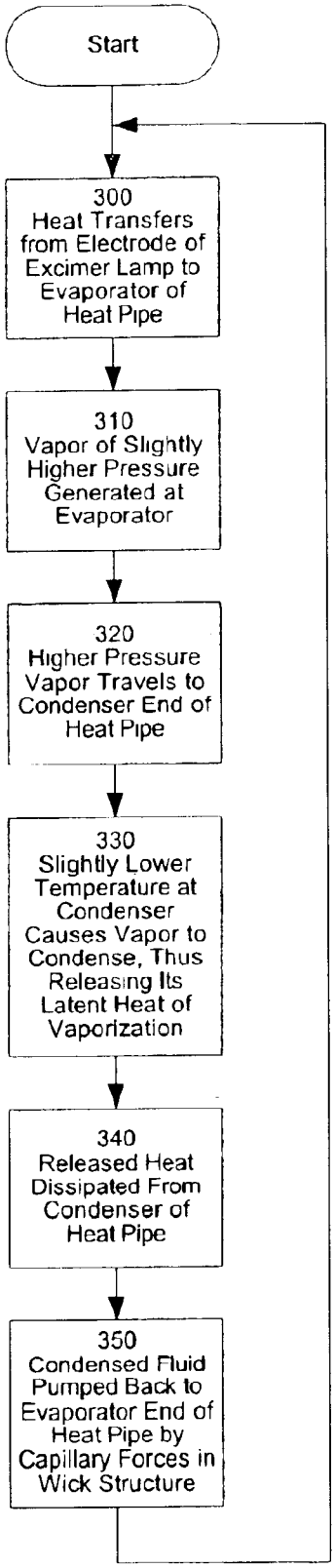
FIG. 3 illustrates of the operation of cooling an excimer lamp using a heat pipe.

FIG. 3 illustrates the operation of cooling an excimer lamp using a heat pipe. During operation of the lamp, as shown at block 300, heat transfers from an electrode of the excimer lamp to the evaporator of a heat pipe. At block 310, this causes vapor of a slightly higher pressure to be generated at the evaporator. At block 320, the higher pressure vapor travels to the condenser end of the heat pipe. The slightly lower temperature at the condenser causes the vapor to condense (block 330), thus releasing its latent heat of vaporization. At block 340, the released heat is dissipated from the condenser of the heat pipe. At block 350, the condensed fluid is pumped back to the evaporator end of the heat pipe by capillary forces in the wick structure.

Heat Pipe on Inside of Lamp

In one embodiment, the heat pipe is on the inside of the lamp. FIG. 4 illustrates a heat pipe on the inside of the lamp in accordance with one embodiment of the present invention. The evaporator end 400 of the heat pipe 410 is in electrical contact with the inner electrode 420 (e.g., aluminum at 10 kV). The heat pipe carries heat away from the excimer lamp 430 and towards the cooling point 440. However, since the heat pipe is in electrical contact with the inner electrode, the cooling point is at the same electric potential as the inner electrode. In some applications, this is not a problem. In other applications, it is desirable to electrically insulate the cooling point from the inner electrode.

FIG. 5 illustrates a heat pipe on the inside of the lamp where the cooling point is electrically insulated from the inner electrode in accordance with one embodiment of the present invention. The heat pipe 500 consists of 3 major parts: a section 510 where the heat is transferred from the glass and inner electrode 520 of the excimer lamp 530 to the heat pipe, a section 540 that has an electrical insulation strength higher than the lamp voltage and a cooling part 550 where the heat is transferred to the environment 560.

Heat Pipe on Outside of Lamp

In another embodiment, a heat pipe is attached to the outside of an excimer lamp. FIG. 6 illustrates a side and end-on view of a heat pipe attached to the outside electrode of an excimer lamp in accordance with one embodiment of the present invention. The heat pipe 600 covers only part of the lamp 610. Heat is transferred to the evaporator end 620 of the heat pipe and travels to the cooling point 630. In one embodiment, since the outside electrode is grounded, no electrical insulation is necessary. In another embodiment, an insulating portion of the heat pipe (similar to the insulating portion of the heat pipe of FIG. 5) is used to electrically separate the cooling point from the outside electrode when the outside electrode is not grounded.

Two Heat Pipes

In another embodiment, two heat pipes are used, one on the inside and one on the outside of an excimer lamp. This allows efficient cooling of the lamp and operation at extremely high power levels. FIG. 7 illustrates a side and end-on view of the use of two heat pipes to cool an excimer lamp in accordance with one embodiment of the present invention. One heat pipe 700 contacts the outside of the excimer lamp 710. Heat is then transferred to a cooling point 720 similarly to the heat pipe of FIG. 6. A second heat pipe 730 contacts the inside of the excimer lamp. The second pipe has an insulating portion 740 to electrically isolate its cooling point 750 from the inner electrode.

Flat Lamp

Figure 8:
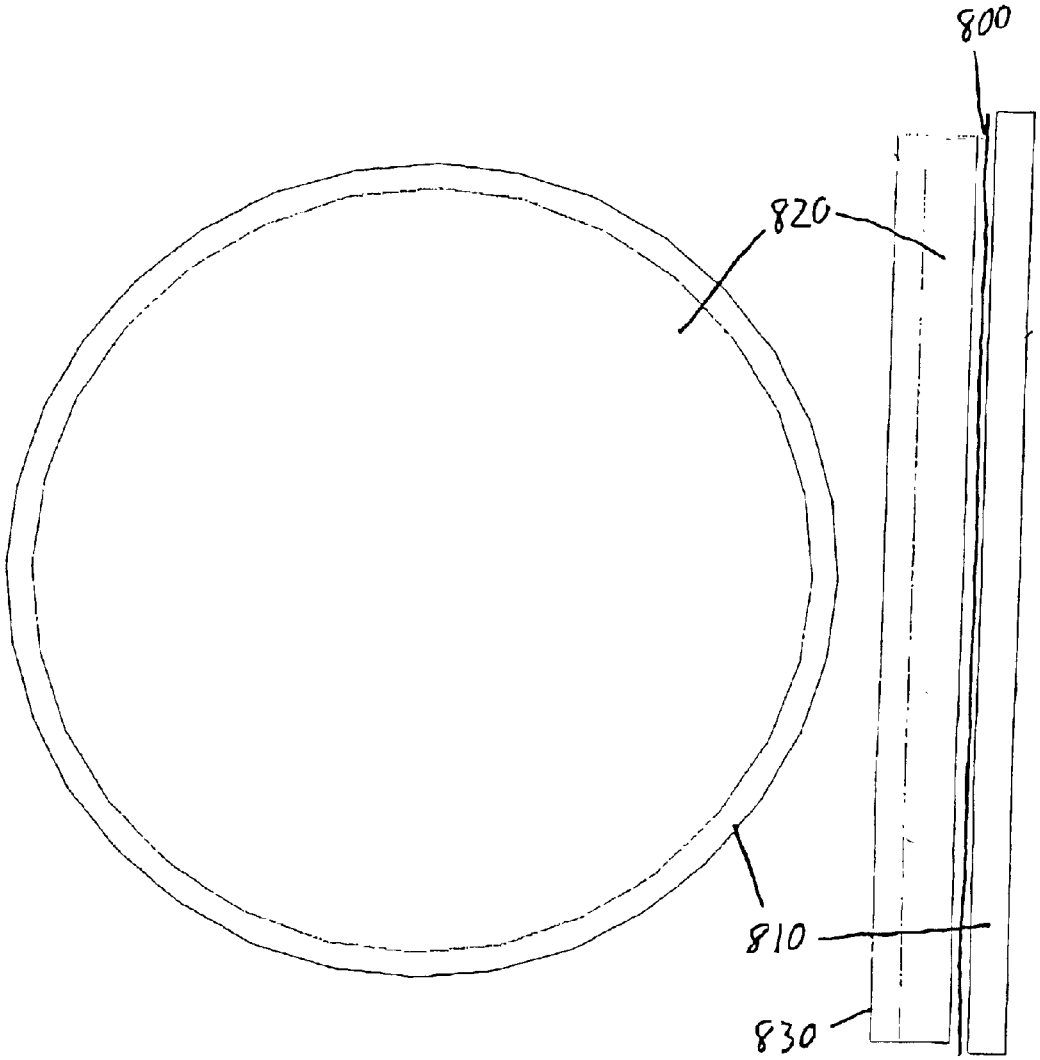
FIG. 8 is a block diagram of a side and end-on view of the use of a heat pipe to cool a flat lamp in accordance with the present invention.

In yet another embodiment, a heat pipe is used with a flat lamp. Flat lamps are described in more detail in U.S. patent application Ser. No. 09/730,185, entitled, "Flat-Panel, Large-Area, Dielectric Barrier Discharge-Driven V(UV) Light Source", file on Dec. 5, 2000. FIG. 8 illustrates a side and end-on view of the use of a heat pipe to cool a flat lamp in accordance with the present invention. One electrode 800 of/the flat lamp 810 is covered by a flat heat pipe 820. The flat heat pipe moves heat from the flat lamp to a cooling point 830.

Figure 9:
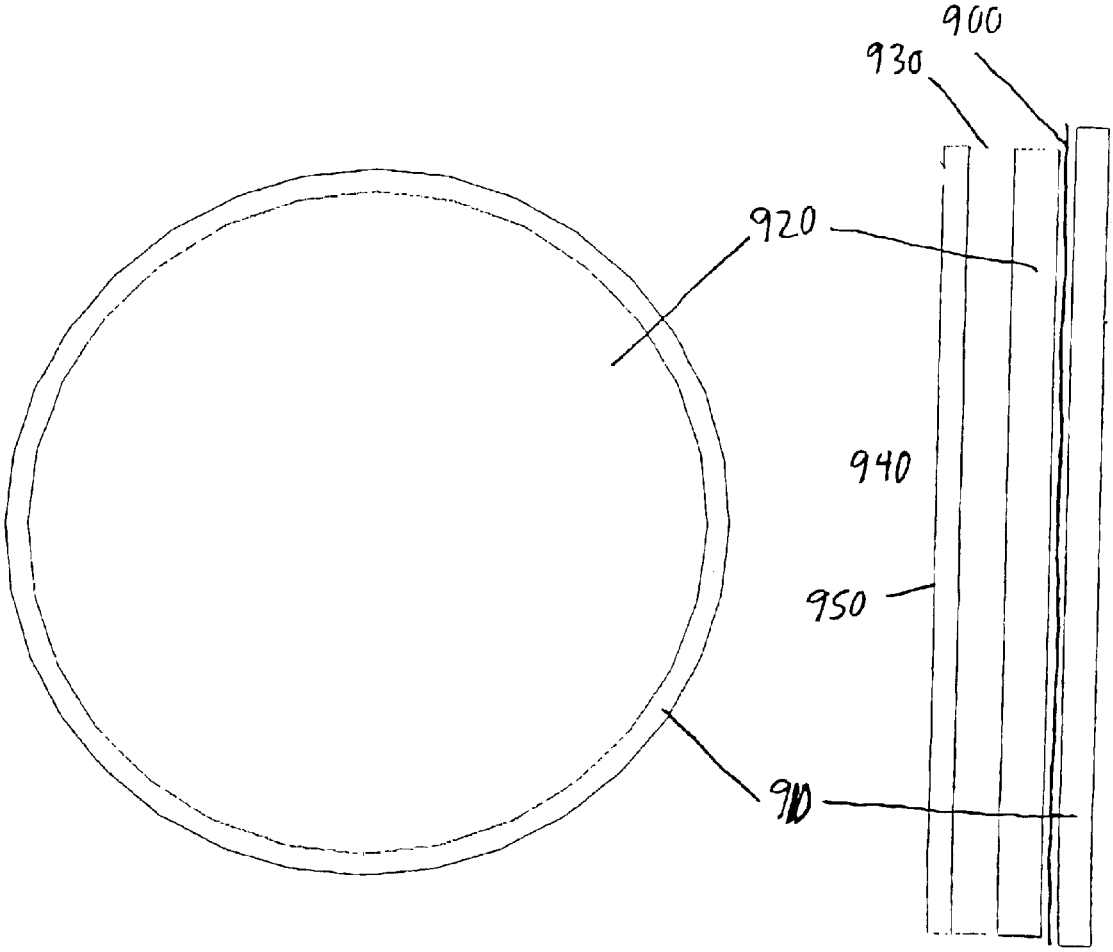
FIG. 9 is a block diagram of a side and end-on view of the use of a heat pipe to cool a flat lamp where the heat pipe has an insulating portion to electrically isolate the lamp electrode from the environment in accordance with the present invention.

In still another embodiment, a flat heat pipe is used with a flat lamp and the heat pipe has an insulation section that electrically isolates the lamp electrode from the environment. FIG. 9 illustrates a side and end-on view of the use of a heat pipe to cool a flat lamp where the heat pipe has an insulating portion to electrically isolate the lamp electrode from the environment in accordance with the present invention. One electrode 900 of the flat lamp 910 is covered by a flat heat pipe 920. The flat heat pipe has an insulating section 930 that electrically isolates the electrode from the environment 940. The heat pipe moves heat from the flat lamp to a cooling point 950, where heat is transferred to the environment.

Thus, a method and apparatus for heat pipe cooling of an excimer lamp is described in conjunction with one or more specific embodiments. The invention is defined by the following claims and their full scope and equivalents.

What is claimed is:

1. A method of cooling an excimer lamp comprising:

connecting a heat pipe to an electrode of said excimer lamp;

transferring heat from said excimer lamp to said heat pipe;

evaporating a liquid to form a vapor in an evaporator of said heat pipe using said heat;

transporting said vapor to a condenser of said heat pipe;

condensing said vapor back into said liquid in said condenser, said act of condensing resulting in a release of heat at a cooling point; and transporting said liquid back to said evaporator through a wick.

2. The method of claim 1 wherein said electrode is an inner electrode.

3. The method of claim 1 wherein said electrode is an outer electrode.

4. The method of claim 1 wherein said excimer lamp is a flat lamp.

5. The method of claim 2, 3 or 4 further comprising:

insulating electrically said cooling point from said electrode.

6. The method of claim 1 further comprising:

connecting a second heat pipe to a second electrode of said excimer lamp.

7. An excimer lamp cooling system comprising:

an excimer lamp;

a heat pipe connected to an electrode of said excimer lamp a heat transferring system configured to transfer heat from said excimer lamp to said heat pipe;

an evaporator of said heat pipe configured to evaporate a liquid to form a vapor using said heat;

a cooling point;

a condenser of said heat pipe configured to condense said vapor back into said liquid, said act of condensing resulting in a release of heat at said cooling point;

a transportation path configured to transport said vapor to said condenser; and a wick configured to transport said liquid back to said evaporator.

8. The excimer lamp cooling system of claim 7 wherein said electrode is an inner electrode.

9. The excimer lamp cooling system of claim 7 wherein said electrode is an outer electrode.

10. The excimer lamp cooling system of claim 7 wherein said excimer lamp is a flat lamp.

11. The excimer lamp cooling system of claim 8, 9 or 10 further comprising:

an insulating portion of said heat pipe configured to electrically insulate said cooling point from said electrode.

12. The excimer lamp cooling system of claim 7 further comprising:

a second heat pipe connected to a second electrode of said excimer lamp.

* * * * *